US006182460B1

(12) United States Patent
Hernandez et al.

(10) Patent No.: US 6,182,460 B1
(45) Date of Patent: Feb. 6, 2001

(54) WINDOW ROOM AIR CONDITIONER

(75) Inventors: Nestor Hernandez, Mirador Residencial Monterrey; David Hernandez, Nuevo Leon; Victoriano Zamora, Nuevo Leon; Jose Oliva, Nuevo Leon, all of (MX)

(73) Assignee: Carrier Corporation, Syracuse, NY (US)

( * ) Notice: Under 35 U.S.C. 154(b), the term of this patent shall be extended for 0 days.

(21) Appl. No.: 09/140,007

(22) Filed: Aug. 26, 1998

(51) Int. Cl.[7] ..... F25D 23/12

(52) U.S. Cl. ..... 62/262; 62/298

(58) Field of Search ..... 62/262, 298

(56) References Cited

U.S. PATENT DOCUMENTS

| | | | | |
|---|---|---|---|---|
| 5,415,011 | * | 5/1995 | Gilmore et al. | 62/262 |
| 5,461,880 | * | 10/1995 | Bolton et al. | 62/298 |
| 5,542,263 | * | 8/1996 | Choi et al. | 62/262 |
| 5,638,693 | * | 6/1997 | Baek | 62/262 |
| 5,687,583 | * | 11/1997 | Tunekawa et al. | 62/404 |
| 5,775,123 | * | 7/1998 | Wakayama et al. | 62/407 |

* cited by examiner

*Primary Examiner*—Henry Bennett
*Assistant Examiner*—Mark Shulman

(57) ABSTRACT

An improved room air conditioner of the type having an indoor section and an outdoor section, which are supported by a basepan and which are separated by a partition. The indoor section includes an indoor fan and an evaporator coil and the outdoor section includes a condenser coil, an outdoor fan and a compressor. The air conditioner is made from two subassemblies, the first subassembly includes a basepan having an indoor region near the front of the basepan and an outdoor region near the back of the basepan. The compressor is supported in the outdoor region and a condenser coil is also supported in the outdoor region rearwardly of the compressor. The evaporator coil is supported in the indoor region and a refrigeration flow circuit interconnects the condenser, the evaporator coil and the compressor. The second subassembly includes a vertically extending partition having an indoor side, an outdoor side and an opening therethrough extending from one side to the other. The partition is configured to cooperate with the basepan to separate the indoor region from the outdoor region. An electric motor is mounted on the outdoor side of the partition. The motor has a drive shaft extending perpendicular to the partition with the first end extending through the opening so that it is on the indoor side of the partition and the second end on the outdoor side of the partition. An indoor fan is mounted to the first end of the drive shaft and an outdoor fan is mounted to the second end of the drive shaft. The second subassembly is configured to be assembled to the first subassembly by positioning the second subassembly in a position vertically spaced above the first subassembly and lowering it into alignment with the first subassembly with the outdoor fan forward of and adjacent to the outdoor heat exchanger, and the indoor fan rearward of and spaced from the indoor heat exchanger. The partition engages the basepan and is structurally attached thereto.

8 Claims, 9 Drawing Sheets

WINDOW ROOM AIR CONDITIONER

BACKGROUND OF THE INVENTION

The present invention is directed to air conditioners and, more particularly, to the assembly of window room air conditioning units.

Air conditioning units such as so-called "window room air conditioners" are commonly used for residential and similar applications and generally include closed refrigeration circuits having an evaporator and a condenser. The unit is normally divided by a partition into an evaporator section and a condenser section. The evaporator section communicating with the room air to be conditioned and the condenser section communicating with external air such as outdoor air. Refrigerant flows through a refrigerant circuit absorbing heat from the room air at the evaporator and discharging heat energy to the external air at the condenser. The conventional refrigeration circuit is completed by the addition of a compressor, an expansion device, and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil, which is mounted vertically in the back of the outdoor section.

In addition to the components mentioned above, the outdoor section also typically includes an outdoor fan and fan orifice, as well as an electric motor, which typically also drives an indoor fan. The indoor section also typically includes the aforementioned indoor fan, an indoor fan orifice, a control box as well as a fan scroll structure for directing the air cooled by the evaporator back into the room to be cooled. Each of the aforementioned components requires means for attaching it to the basepan and/or other structure of the air conditioning unit. Numerous approaches are known for assembly of the components of said unit. However, it is desirable to design a unit which may be assembled in a manner which will minimize the total number of individual components in the unit. The fewer components and the fewer number of attachment means results in lower material costs, less labor content and, accordingly, a less expensive unit.

SUMMARY OF THE INVENTION

An improved room air conditioner of the type having an indoor section and an outdoor section, which are supported by a basepan and which are separated by a partition. The indoor section includes an indoor fan and an evaporator coil and the outdoor section includes a condenser coil, an outdoor fan and a compressor. The air conditioner is made from two subassemblies, the first subassembly includes a basepan having an indoor region near the front of the basepan and an outdoor region near the back of the basepan. The compressor is supported in the outdoor region and a condenser coil is also supported in the outdoor region rearwardly of the compressor. The evaporator coil is supported in the indoor region and a refrigeration flow circuit interconnects the condenser, the evaporator coil and the compressor. The second subassembly includes a vertically extending partition having an indoor side, an outdoor side and an opening therethrough extending from one side to the other. The partition is configured to cooperate with the basepan to separate the indoor region from the outdoor region. An electric motor is mounted on the outdoor side of the partition. The motor has a drive shaft extending perpendicular to the partition with the first end extending through the opening so that it is on the indoor side of the partition and the second end on the outdoor side of the partition. An indoor fan is mounted to the first end of the drive shaft and an outdoor fan is mounted to the second end of the drive shaft. The second subassembly is configured to be assembled to the first subassembly by positioning the second subassembly in a position vertically spaced above the first subassembly and lowering it into alignment with the first subassembly with the outdoor fan forward of and adjacent to the outdoor heat exchanger, and the indoor fan rearward of and spaced from the indoor heat exchanger. The partition engages the basepan and is structurally attached thereto.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENT

Figure 1:
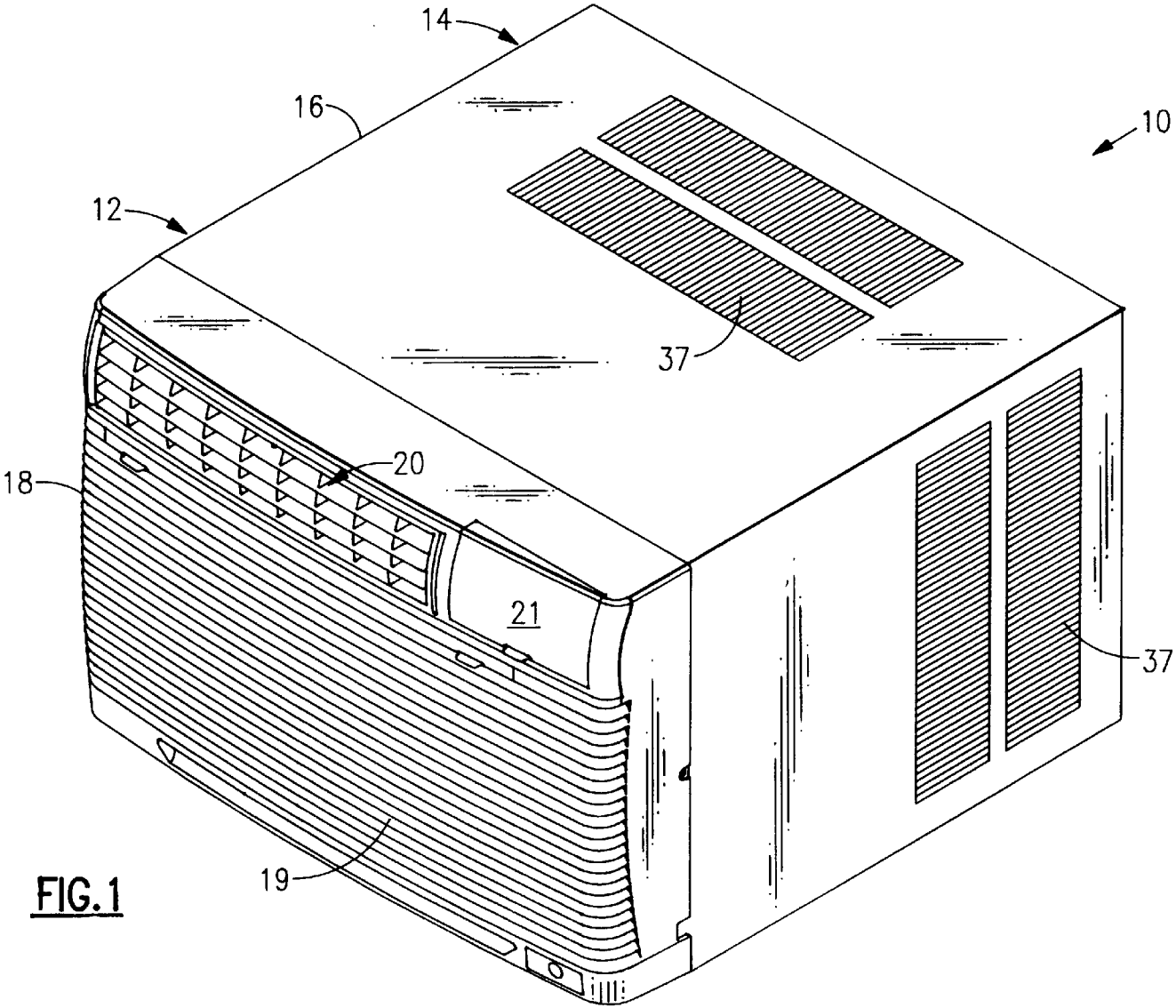
FIG. 1 is a perspective view of a room air conditioner which embodies the features of this invention.

FIG. 1 illustrates a room air conditioner unit 10 which includes generally an indoor section 12 and an outdoor section 14. The air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille section 18, which includes inlet louvers 19 and an air discharge assembly 20. The front grille 18 also includes a door 21 in the upper right-hand comer, which covers a control panel 22 for the unit as will be seen in the other drawing figures.

Figure 2:
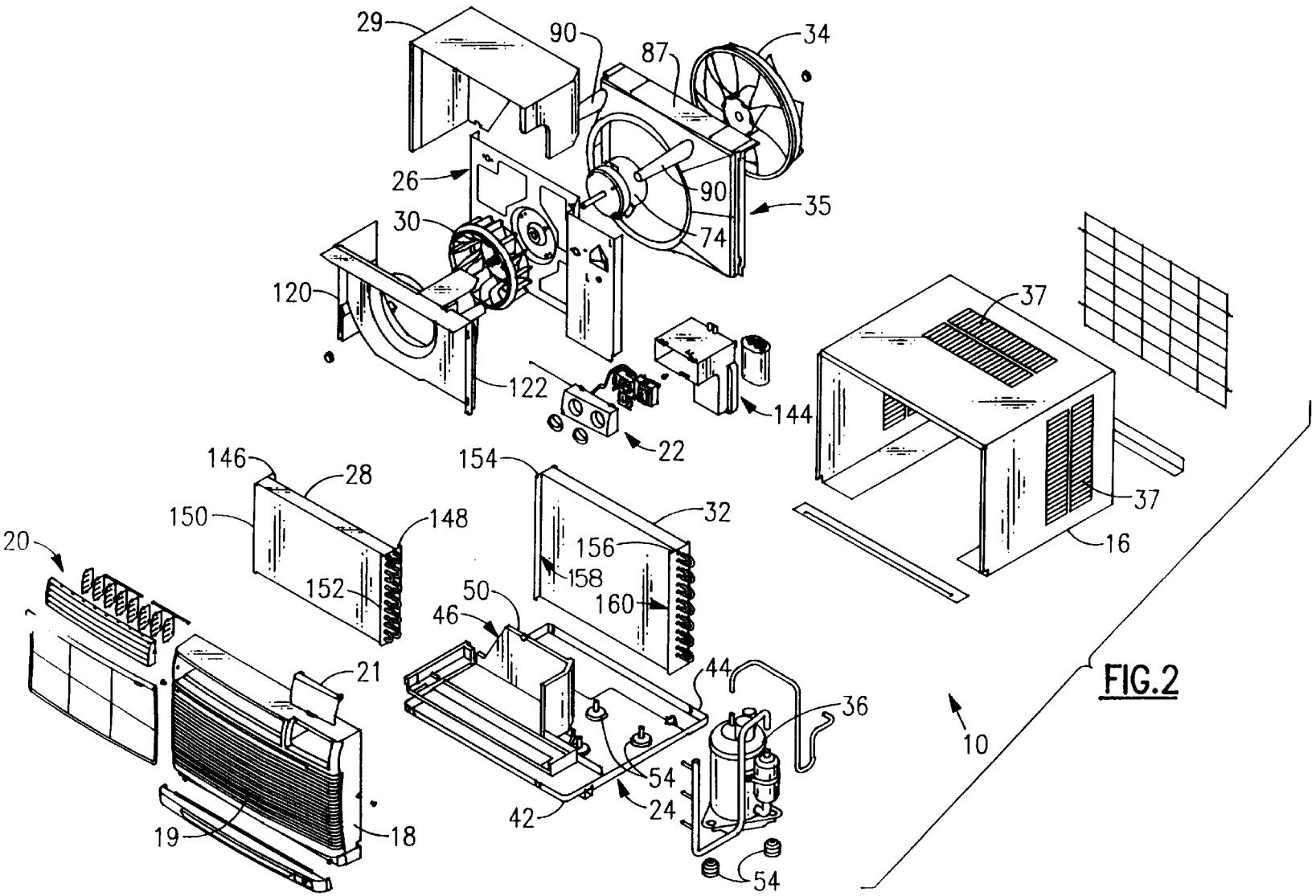
FIG. 2 is an exploded view of the air conditioner illustrated in FIG. 1.
Figure 12:
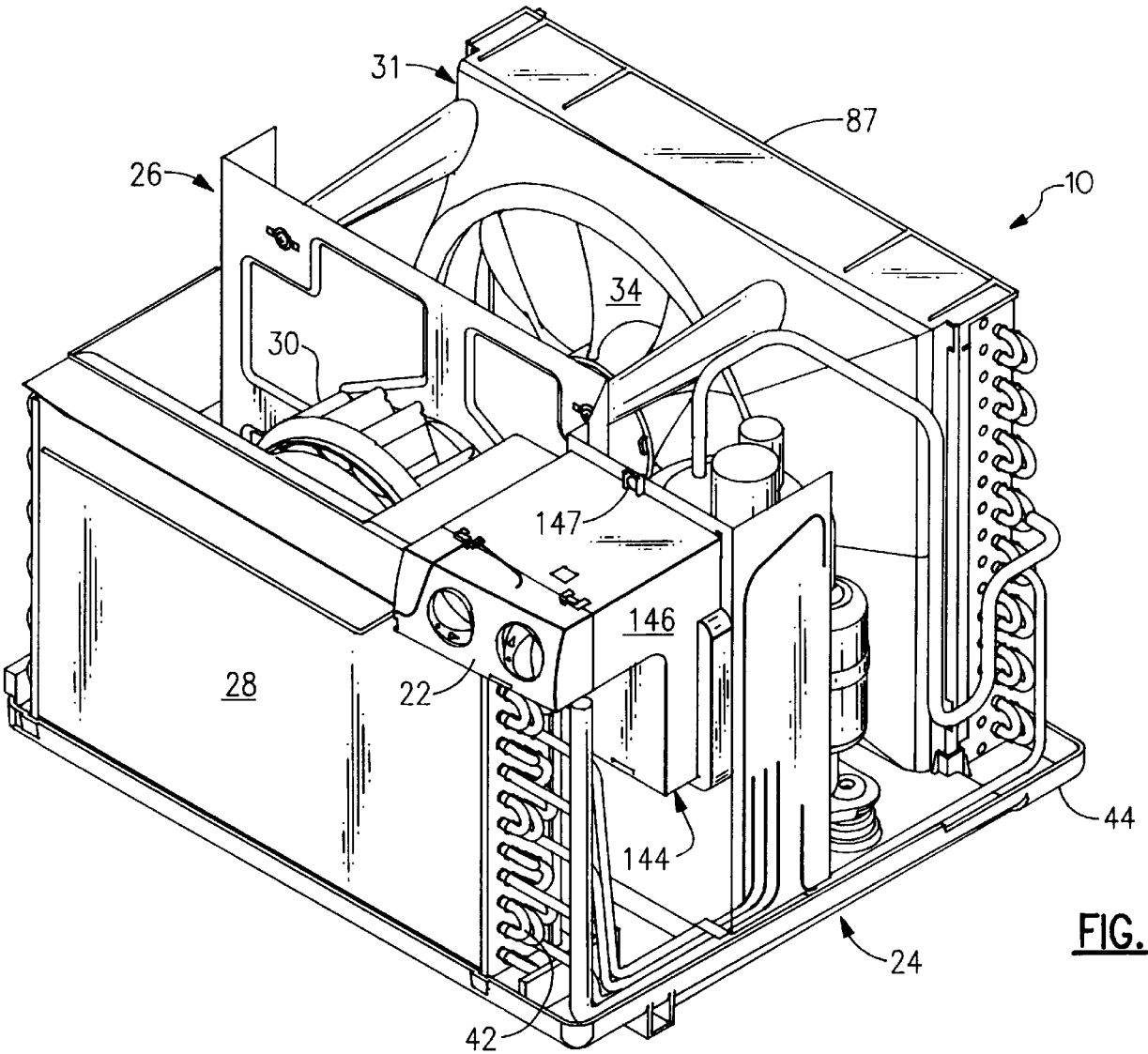
FIG. 12 illustrates the first and second subassemblies assembled to one another.

Looking now at FIGS. 2 and 12, the components of both the indoor section 12 and outdoor section 14 are supported in a rectangular basepan 24. The indoor and outdoor sections are separated by a vertically extending metal partition 26, which is illustrated in more detail in FIGS. 3 through 9. The indoor section comprises basically an evaporator coil 28 vertically disposed at the front end thereof, an evaporator or indoor fan 30 located behind the evaporator 28 and an air directing scroll 29.

The outdoor section 14 includes a condenser coil 32 vertically disposed adjacent the back end thereof, a condenser fan 34, located adjacent the condenser coil, and a fan orifice 35. The unit's compressor 36 is also located in the outdoor section 14. The condenser coil 32 is fluidly interconnected with the compressor 36 and the evaporator 28 in a conventional manner to provide cooling to the room in which the unit is installed.

During operation, air from the space to be conditioned by the unit is drawn by action of the evaporator fan 30 through the inlet louvers 19 and is directed through the evaporator coil 28 where the air is cooled. The cooled air is then directed by the scroll 29 back into the room to be cooled through the air discharge assembly 20. At the same time, ambient air is drawn through inlets 37 in the outside section of the housing 16 and through the orifice 35, by operation of the condenser fan 34, and is directed through the condenser coil 32 before exiting from the backside of the condenser coil.

Figure 11:
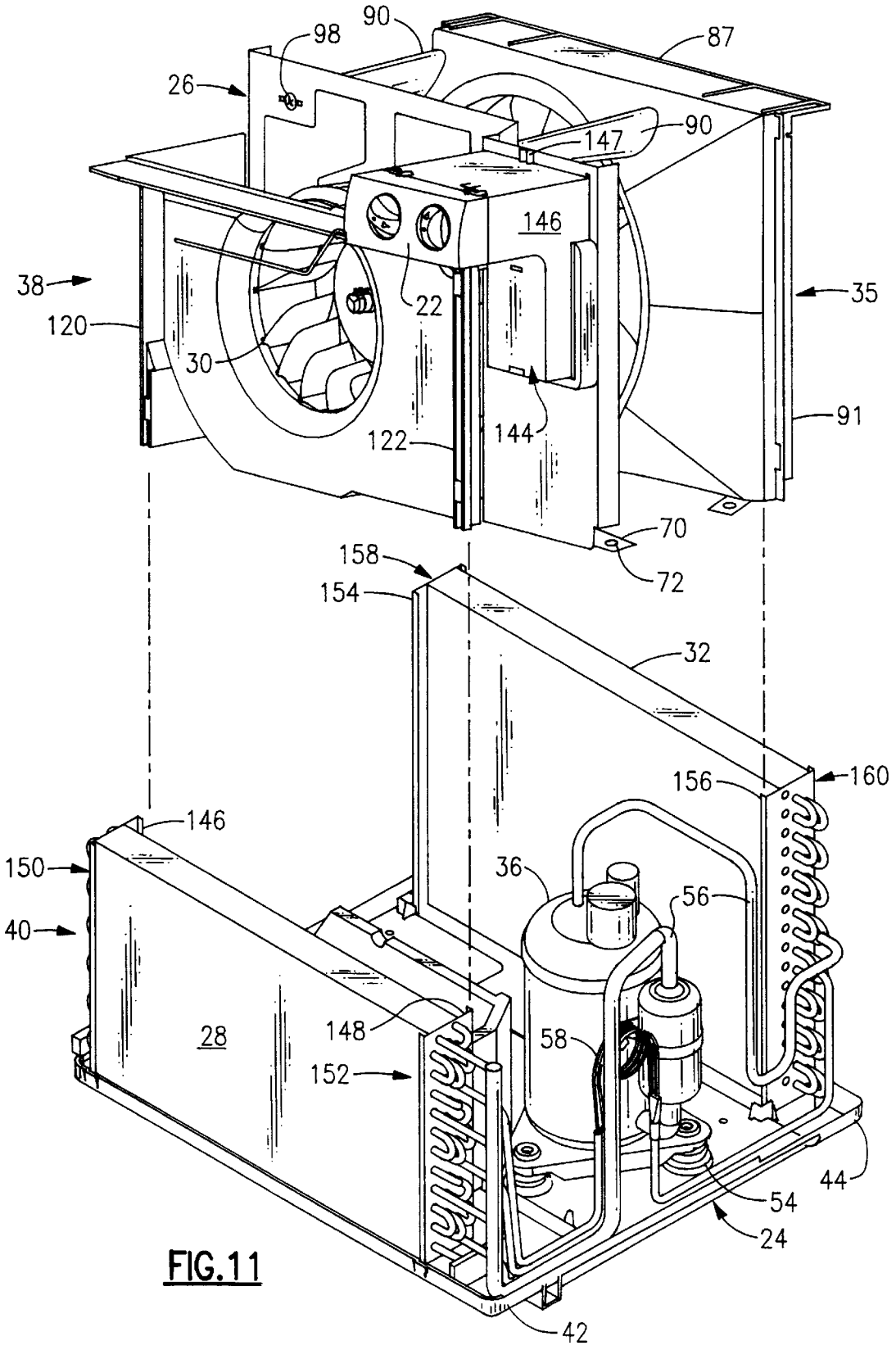
FIG. 11 illustrates the subassembly of FIGS. 3–9 in position prior to assembly to the second subassembly according to the present invention.

According to the present invention, all of the components of the air conditioning unit 10 which are contained within the housing 16 and the indoor grille 18 are assembled in two major subassemblies, which are then easily assembled to one another prior to installation of the housing 16 and the indoor grille 18 complete assembly of the unit. FIG. 11 illustrates the two major subassemblies, which will hereinafter be referred to with reference to their relative positions as illustrated in FIG. 11, which are their positions prior to assembly to one another. Accordingly, reference numeral 38 refers to the upper subassembly and reference numeral 40 refers to the lower subassembly, as illustrated in FIG. 11. As will be seen, FIG. 12 illustrates the result of the assembly of the upper subassembly 38 to the lower subassembly 40.

Looking first at FIG. 11, and with further reference to FIG. 2, the lower subassembly 40 comprises the previously described basepan 24, which has an indoor region 42 proximate the front of the basepan and an outdoor region 44 proximate the back of the basepan. The first component installed in the indoor region 42 of the basepan is a lower portion 46 of the scroll 29. The lower scroll section 46 is made from a molded polystyrene foam material and includes a condensate drain pan section 48 and a vertically extending section 50, which forms the lower part of the scroll assembly. This component is illustrated in detail in FIG. 9. The evaporator coil 28 is then positioned with its lower end supported by the condensate drain pan 48. Following this, the condenser coil 32 is positioned in the backside of the outdoor region 44 of the basepan, as shown. The compressor 36 is then appropriately attached as illustrated in the drawing figures to the basepan in the outdoor region 44 through appropriate attachment hardware, including mounting studs and vibration isolating bushings 54. The condenser coil 32, the compressor 36, and the evaporator coil 28 are then appropriately interconnected to one another by refrigerant tubing generally 56, including a capillary tube expansion device 58, as is conventional. Following such assembly, the refrigeration system may be evacuated and charged with refrigerant and, as illustrated in FIG. 11, is ready for installation of the upper subassembly 38 thereto.

Figure 3:
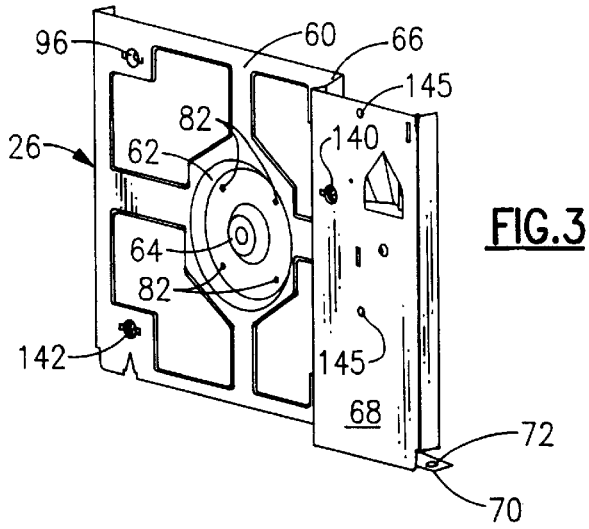
FIGS. 3–8 illustrate the sequence of steps in the assembly of one of the subassemblies of the air conditioning unit illustrated in FIG. 1.

The sequence of assembly of the upper subassembly 38 begins as illustrated in FIG. 3 with the metal partition 26, to which all of the other components of the upper subassembly are attached. The partition is fabricated from galvanized sheet steel and comprises a major planar section 60 having a centrally located circular recess 62 formed therein which has a centrally located circular opening 64 extending therethrough. Extending forwardly from the right-hand edge of the planar section 60 is an intermediate section 66 from which a second smaller planar section 68 extends. The bottom edges of both of the planar sections 60 and 68 are provided with perpendicularly extending mounting flanges 70 with openings 72 therethrough, which facilitate mounting of the partition to the basepan 24 by suitable fasteners (not shown) to attach the subassembly 38 to the finished unit.

Figure 4:
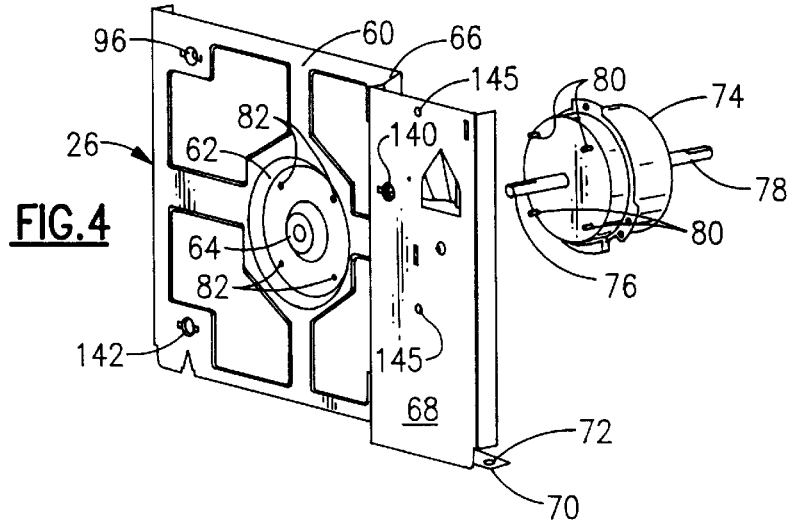
Figure 5:
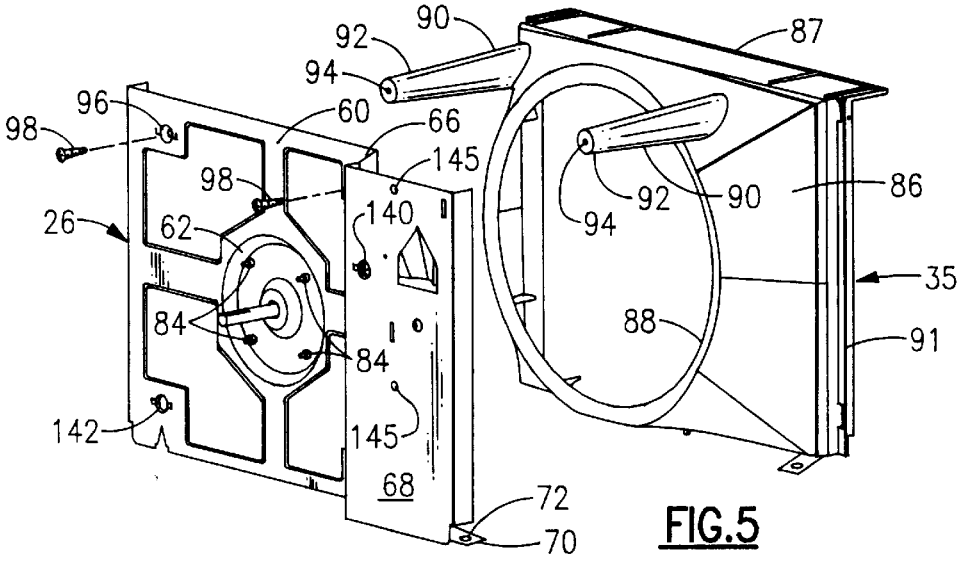

Looking now at FIG. 4, an electric motor 74 having a drive shaft section 76 extending from the front end thereof and a drive shaft section 78 extending from the back side thereof is assembled to the partition 26 by inserting the front shaft section 76 through the opening 64 and passing four mounting bolts 80, integrally formed with the motor, through mating openings 82 in the recess 62. Appropriate threaded nuts 84 are assembled to the four mounting bolts 80, as illustrated in FIG. 5. As thus assembled, the ends of the mounting bolts 80 and the nuts carried thereby extend into the recess 62 but do not extend beyond the plane of the planar section 60 and, thus, as will be seen, will, when assembled, not interfere with the indoor scroll section, which is assembled in close proximity to the planar section.

The outdoor fan orifice 35 comprises a one-piece plastic component preferably molded from a 20% talc-filled polypropylene material. The orifice 35 comprises a main body section 86 defining the fan orifice 88 therein. A horizontally extending flange 87 projects rearwardly from the top of the main body section. This flange is configured to overlie and retain the condenser coil, as will be seen. The man body has left and right edges 89 and 91, respectively, which are provided with vertically extending channels which are adapted to engage the tube sheets of the condenser coil, as will be described in detail below. Extending forwardly from the top of the main body section are a pair of tubular spacers 90, which extend from a large diameter section where they are integrally formed with the main body section to smaller diameter ends 92, which are provided with openings 94 therein adapted to structurally receive threaded fasteners. The ends 92 of the spacers and the openings 94 therein are adapted to be axially aligned with through openings 96 in the large planar section 60 of the partition through which appropriate threaded fasteners 98 are passed and threadably engaged with the openings 94 in the spacers to thereby attach the fan orifice 35 to the partition, as illustrated in FIG. 6.

Figure 6:
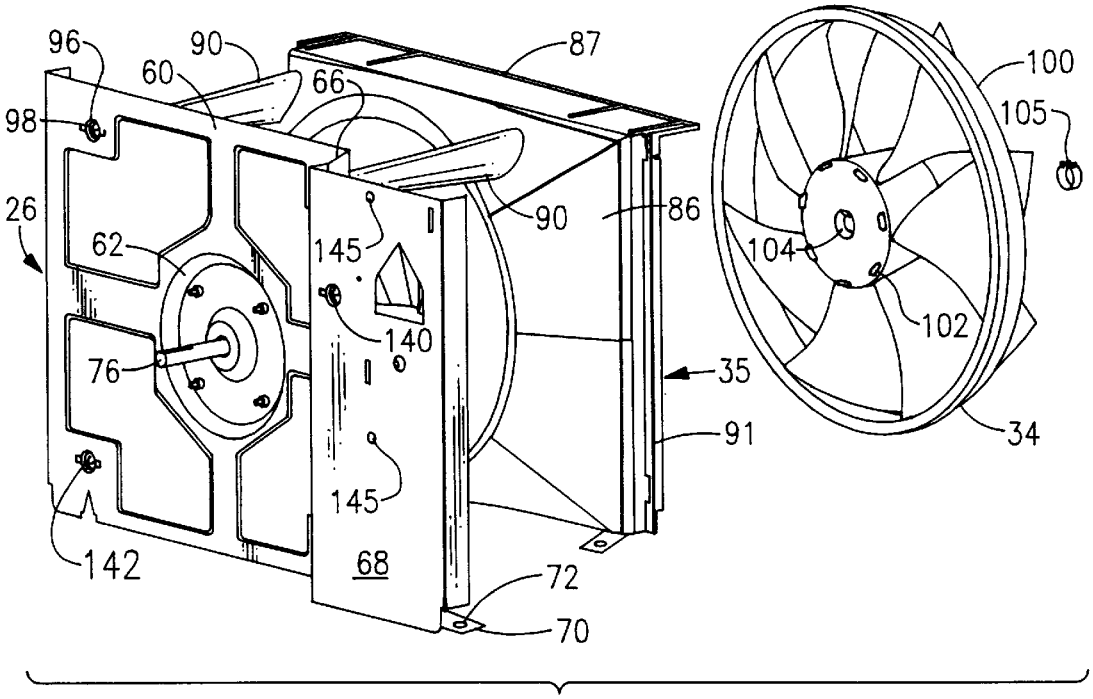

With continued reference to FIG. 6, the next step in assembly of the upper subassembly 38 is attachment of the outdoor fan 34, which comprises a propeller type fan having a peripherally extending outer slinger ring 100. The fan has a central hub 102 having an axial opening 104 therein, which is adapted to receive the motor shaft 78 therein. In the illustrated embodiment, the axial opening 104 is a blind opening and the shaft is inserted therein until it contacts the end of the blind opening and a suitable outer attaching clamp 105 is installed to rotationally and axially attach the fan 34 to the motor shaft.

Figure 7:
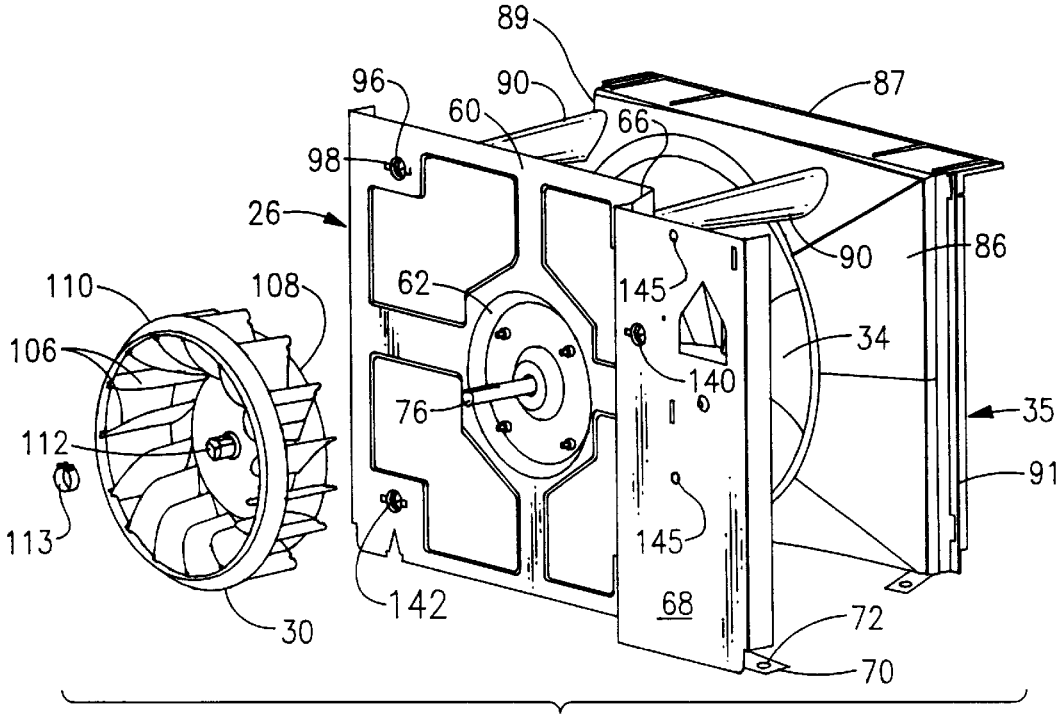

Looking now at FIG. 7, the indoor fan 30 is a centrifugal fan having a plurality of radially extending peripherally located blades 106 supported by a closed back section 108 and a front peripherally extending ring 110. A centrally extending axial opening (not shown) is formed in fan hub 112 and is adapted to receive the end of the front motor shaft 76 therein in a blind fashion and is axially and rotationally affixed to the shaft by a clamp mechanism 113.

Figure 8:
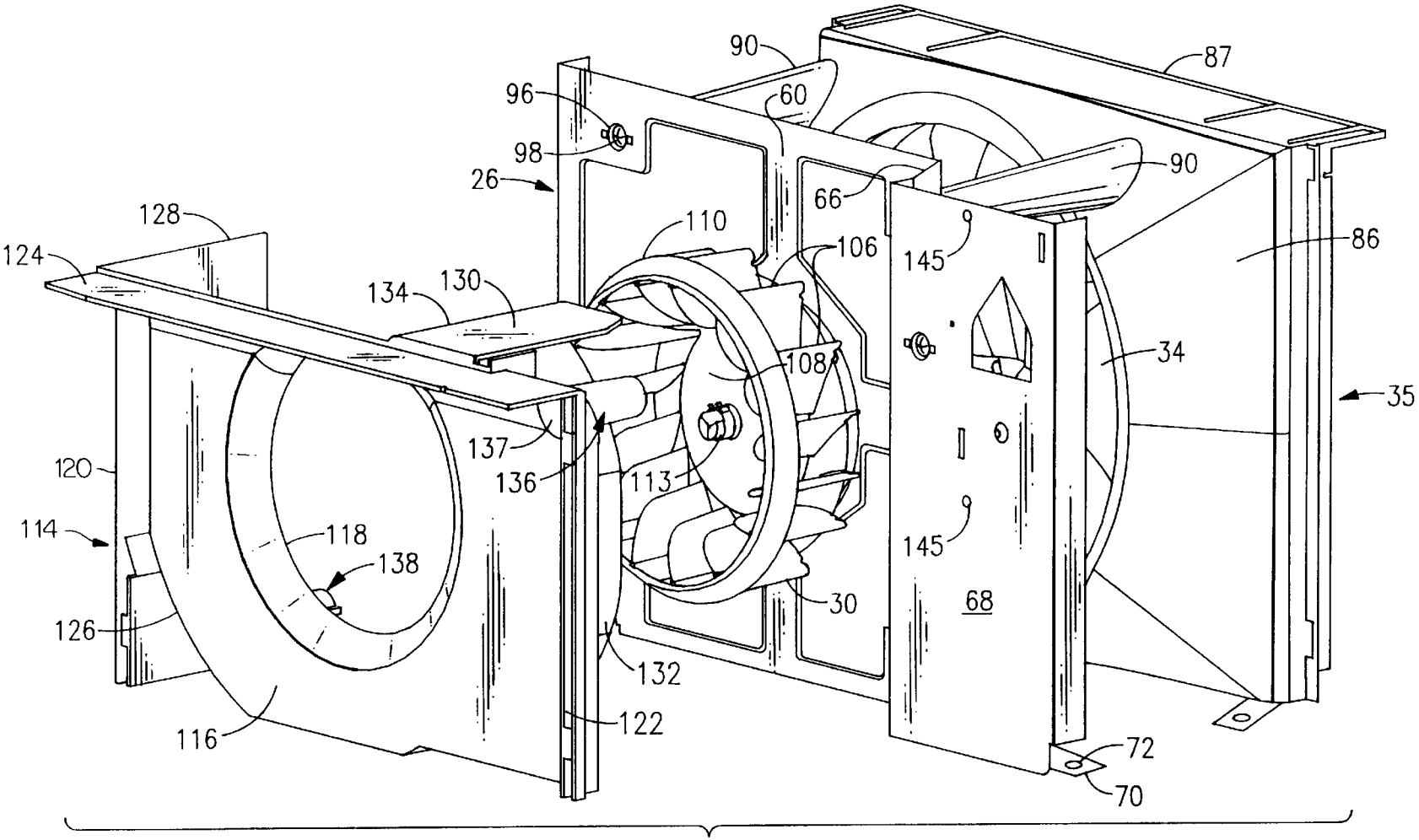

Turning now to FIG. 8, reference numeral 114 generally designates a one-piece component which serves to define the indoor fan orifice, and a portion of the indoor scroll assembly 29. This component 114 will be referred to as the "evaporator orifice 114" and as with the condenser is molded from a talc filled polypropylene plastic material. The evaporator orifice 114 comprises a substantially planar main body section 116 having an opening 118 therein, which is approximately the same diameter as the peripheral ring 110 of the indoor fan 30. The main body section has left and right-hand edges 120 and 122, respectively, which are provided with vertically extending channels which are adapted to engage the evaporator coil, as will be described in detail below. A horizontally extending flange 124 projects forwardly from the upper end of the main body section 116. This flange is adapted to overlie and retain the evaporator coil, as will be seen. Reference numeral 126 indicates a curved wall portion on the left side of the main body section, which transitions to a vertically extending wall section 128 on the left-hand side of the main body section, which together form a curved portion of the indoor fan scroll. As best seen in FIG. 8, a horizontally extending wall section 130 extends rearwardly from the upper end of the main body section 116. The horizontal wall section 130 forms part of the vortex wall separator for the indoor fan 30. A curved wall 132 extends downwardly and to the left from the left-hand edge 134 of the horizontal wall section and blends into the curved wall section 126 to complete the lower part of the indoor fan scroll.

Extending rearwardly from the back of the main body section 116 are two hollow tubular mounting spacers 136 and 138. The first of these spacers, 136, extends from the upper right-hand comer of the main body section 116 while the second spacer, 138, extends from the lower left-hand comer thereof. As best seen in FIG. 8, for the spacer 136, each of the spacers are hollow and have an opening 137 at the back end thereof, which is adapted to receive a threaded fastener therethrough which, in turn, is adapted to be received in openings 140, for spacer 136, and 142 for spacer 138 in the metal partition 26.

The control box 144 is the last component to complete the assembly of the upper subassembly 38. The control box comprises a substantially inverted L-shaped housing 146 having a mounting lug 147 extending from the upper end thereof and a second mounting lug (not shown) extending from the lower end thereof. A suitable threaded fastener extends through the mounting lug 147 and the lower mounting lug and into suitable openings 145 provided in the second planar section 68 of the partition 26 to thereby attach the control box to the partition.

Completion of assembly of the air conditioning unit 10 is then readily accomplished by positioning the upper assembly 38 with respect to the lower subassembly 40, as illustrated in FIG. 11. As will be noted by the phantom lines interconnecting the two subassemblies, the channels carried by the left and right edges 120 and 122 of the evaporator orifice 114 are positioned in a vertical overlying relationship with left and right edges 146 and 148 of the left and right tube sheets 150 and 152, respectively, of the evaporator coil 28. In a like manner, guide channels 89 and 91 on the left and right edges of the main body section 86 of the condenser orifice 35 are positioned in vertically spaced overlying relationship with the left and right inside comers 154 and 156 of the left and right tube sheets 158 and 160 of the condenser coil 32.

It is contemplated that on an assembly line the lower subassembly 40 will be on a support surface such as a conveyor belt or the like and that the upper subassembly 38 will be positioned as illustrated in FIG. 11 by assembly line workers grasping the left and right-hand sides of the unit, positioning it as illustrated in FIG. 11, and lowering the unit 38 with the above described channels sliding into engagement with the tube sheet comers. As this occurs, the major components of the upper subassembly 38 will move into their final assembled position with respect to the components of the lower subassembly 40 as follows. The one-piece component 114 and the main body section 116 thereof will be located directly behind the evaporator coil 28 with the horizontally extending flange 124 in direct overlying relationship with the evaporator, as seen in FIG. 12. The vertically extending portion of the scroll 50 carried in the lower subassembly will be received into a space lying behind the indoor fan 30 and forward of the partition wall 26. The partition wall 26 will move into the position illustrated in FIG. 12 with the mounting flanges 70 at the lower end thereof moving into direct contact with the upper surface of the basepan with the openings therein in register with openings in the basepan to permanently attach the partition thereto.

At the same time, the main body section 86 of the outdoor fan orifice 35 moves downwardly with the flange 87 overlying the condenser coil and the channels cooperating with the tube sheet edges. The condenser fan will move into final position forward of and adjacent to the condenser coil 43.

Figure 9:
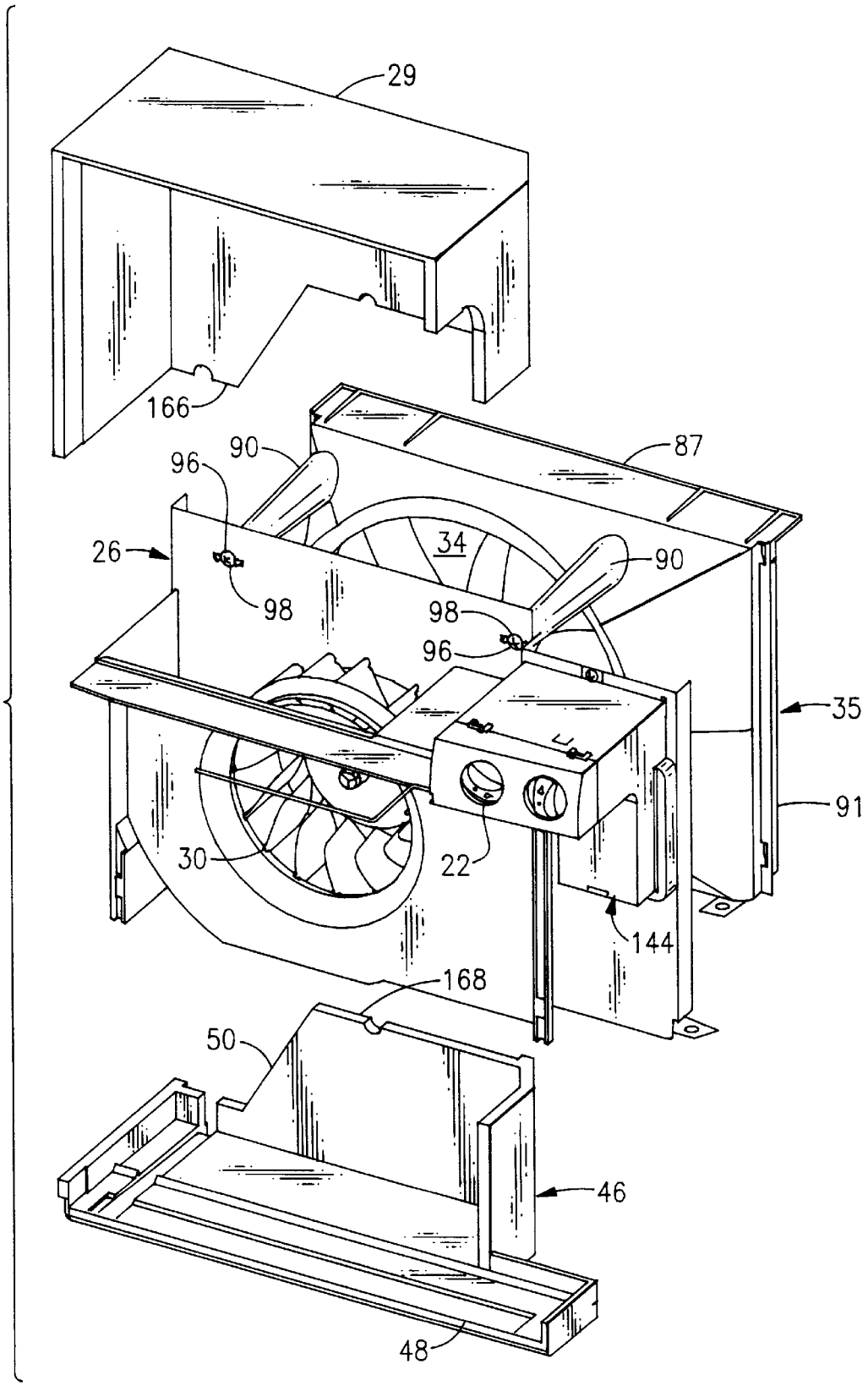
FIG. 9 is an exploded view illustrating the completed subassembly of FIGS. 3–8 and its relationship to the components of the indoor scroll.
Figure 10:
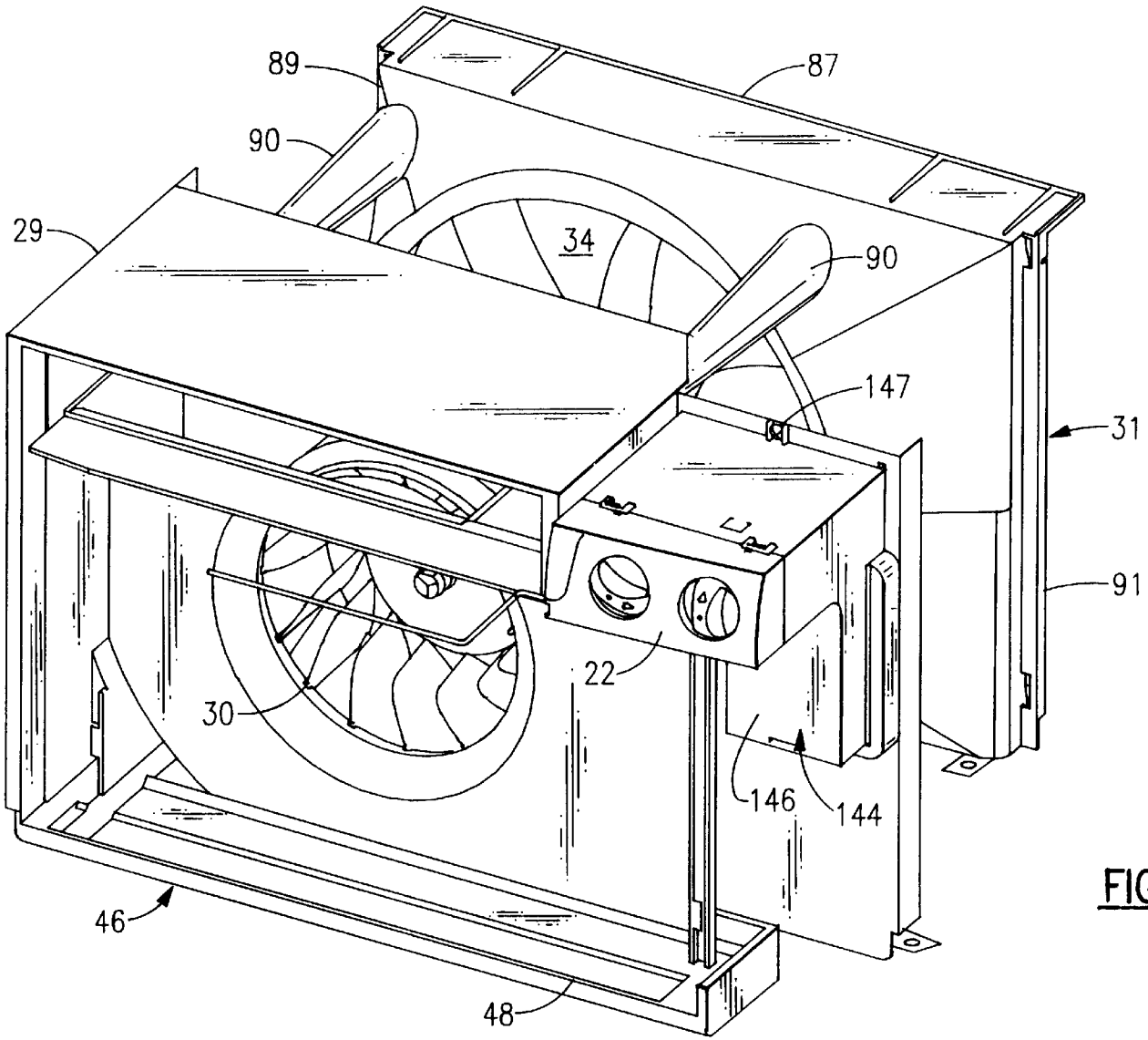
FIG. 10 is an assembled view of the components illustrated in FIG. 9.

Following this, completion of the air conditioning unit is accomplished by inserting the upper scroll section 29, as best shown in FIG. 9, into the space defined between the back of the indoor fan 30 and the front of the partition 26. Again, as best seen in FIG. 9, this component has a lower edge 166 which is configured to be complementary to the upper edge 168 of the vertical wall section 50 of the lower scroll component 46. As thus assembled, the unit is then completed by sliding the basepan 24 and the completed unit into the outer housing 16 and assembling the indoor grille section 18 thereto.

What is claimed is:

1. A room air conditioner of the type having an indoor section and an outdoor section, which are supported by a base pan, and which are separated by a partition, the indoor section includes an indoor fan and an evaporator coil, and the outdoor section includes a condenser coil, an outdoor fan and a compressor, wherein the improvement comprises:

a first subassembly comprising:

a base pan having an indoor region proximate the front of said base pan and an outdoor region proximate the back of said base pan;

a compressor supported in said outdoor region;

a condenser coil supported in said outdoor region rearwardly of said compressor;

an evaporator coil supported in said indoor region; and a refrigeration flow circuit interconnecting said condenser coil, said evaporator coil, and said compressor; and a second subassembly comprising:

a vertically extending partition having an indoor side, an outdoor side, and an opening therethrough extending from said indoor side to said outdoor side, said partition being configured to cooperate with said base pan to separate said indoor region from said outdoor region;

an electric motor mounted on said outdoor side of said partition, said motor having a drive shaft extending perpendicular to said partition with a first end extending through said opening so that it is on said indoor side of said partition, and a second end on said outdoor side of said partition;

an indoor fan mounted to said first end of said drive shaft; and an outdoor fan mounted to said second end of said drive shaft;

said first subassembly and said second subassembly each being configured such that they may be assembled separate from one another and such that said second subassembly may be assembled to said first subassembly by positioning said second subassembly in a position vertically spaced above said first subassembly and lowering said second subassembly into a predetermined alignment with said first subassembly with said outdoor fan forward of and adjacent to said outdoor heat exchanger, and said indoor fan rearward of and spaced from said indoor heat exchanger, and with said partition engaging said base pan; and means for attaching said partition to said base pan.

2. The apparatus of claim 1 wherein said second subassembly further includes an outdoor fan orifice plate having an opening therein surrounding said outdoor fan, said orifice plate having integrally formed means for attachment of said orifice plate to said partition; and an integrally formed indoor fan orifice and scroll assembly cooperating with said indoor fan, said assembly having means for attachment of said assembly to said partition.

3. The apparatus of claim 2 wherein said outdoor fan orifice plate further includes a peripherally extending curved wall, which defines said fan opening at one end thereof, nearest said partition, said curved wall transitioning to a substantially rectangular frame, said frame having a top, bottom, and left and right sides, said bottom being configured to engage said base pan, said top having a horizontal flange extending rearwardly thereof, which is configured to overlie said outdoor heat exchanger.

4. The apparatus of claim 3 wherein said left and right sides of said rectangular frame are configured to engage and align left and right sides, respectively, of said outdoor heat exchanger.

5. The apparatus of claim 3 wherein said indoor fan is a centrifugal fan having a forward facing circular inlet and a peripherally extending radially outwardly directed outlet;

wherein said indoor fan orifice and scroll assembly comprises a planar wall disposed between said indoor heat exchanger and said indoor fan inlet, said planar wall having an inlet orifice therein in axial alignment with said fan inlet, said planar wall having flanges extending forwardly from said upper end and said left and right sides thereof, said flanges being configured to engage and align said indoor heat exchanger.

6. The apparatus of claim 5 wherein said fan orifice and scroll assembly further comprises a curved wall extending rearwardly from said planar wall, said curved wall extending in peripheral spaced relation with said indoor fan outlet and having an open upper end through which air flow from said fan is directed; and means for closing the back of said curved wall to thereby enclose the rear of said indoor fan, and for receiving air flow from said open upper end and redirecting said air flow forwardly thereof.

7. The apparatus of claim 6 wherein said means for closing and receiving and redirecting air flow comprises a two-piece plastic foam structure having a first section thereof disposed between said indoor side of said partition and the back of said curved wall, said first section lying substantially under said motor shaft opening and said partition, and a second section also disposed intermediate said indoor side of said partition and the back of said curved wall, said second section lying substantially above said motor shaft opening in said partition;

said first section and said second section having a substantially air tight interface therebetween.

8. The apparatus of claim 7 wherein said second section further includes a top wall extending perpendicularly and horizontally in spaced relation to said open upper end, and left and right side walls at opposite ends of said top wall to thereby define a plenum for receiving air flow from said open end and redirecting said air flow forwardly thereof.

* * * * *